US006578213B2

(12) United States Patent
Dabney

(10) Patent No.: US 6,578,213 B2
(45) Date of Patent: Jun. 17, 2003

(54) STACKABLE BEDDING FOUNDATION

(75) Inventor: Upton Dabney, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/927,028

(22) Filed: Aug. 9, 2001

(65) Prior Publication Data

US 2002/0069463 A1 Jun. 13, 2002

Related U.S. Application Data

(60) Provisional application No. 60/254,122, filed on Dec. 8, 2000.

(51) Int. Cl.[7] ..... A47C 23/02; A47C 23/04

(52) U.S. Cl. ..... 5/247; 5/255; 5/257; 5/260; 5/719; 5/716; 267/103

(58) Field of Search ..... 5/247, 255, 257, 5/260, 719, 716; 267/103, 104, 105, 106, 107, 95

(56) References Cited

U.S. PATENT DOCUMENTS

| | | | | |
|---|---|---|---|---|
| 4,377,279 | A | 3/1983 | Schulz et al. | |
| 4,739,977 | A | 4/1988 | Dabney | |
| 4,771,995 | A | 9/1988 | Wells et al. | |
| 4,960,267 | A | * 10/1990 | Scott | 267/91 |
| 5,052,064 | A | 10/1991 | Hagemeister et al. | |
| 5,176,367 | A | 1/1993 | Rodgers et al. | |
| 5,178,372 | A | 1/1993 | Rodgers et al. | |
| 5,246,210 | A | 9/1993 | Dabney et al. | |
| 5,361,434 | A | 11/1994 | Hagemeister et al. | |
| 5,370,374 | A | 12/1994 | Rodgers et al. | |
| 5,395,097 | A | 3/1995 | Dabney et al. | |
| 5,401,007 | A | 3/1995 | Dabney et al. | |
| 5,652,986 | A | 8/1997 | Wells | |
| 5,704,595 | A | 1/1998 | Kitchen et al. | |
| 5,720,471 | A | 2/1998 | Constantinescu et al. | |
| 6,134,729 | A | 10/2000 | Quintile et al. | |

* cited by examiner

*Primary Examiner*—J. J. Swann
*Assistant Examiner*—Katherine Mitchell
(74) *Attorney, Agent, or Firm*—Wood, Herron & Evans, L.L.P.

(57) ABSTRACT

A nestably stackable assembly for use in a bedding foundation. The assembly has a rectangular border wire with parallel sides and ends. Transversely spaced, parallel and longitudinally extending support wires are connected at their ends to the border wire ends. The support wires are formed so as to be generally corrugated along their lengths with peaks and valleys. The peaks are flattened at their tops, and the flattened tops are generally coplanar with a plane defined by the border wire. The valleys are vertically displaced beneath and intermediate of the flattened tops. Longitudinally spaced and transversely extending, upper connector wires are connected to the sides of border wires, and the upper connector wires are connected along their lengths to the flattened tops of the peaks of the support wires. The valleys have flattened bottoms, and adjacent pairs of the flattened bottoms of the valley are interconnected by resilient connectors.

24 Claims, 6 Drawing Sheets

STACKABLE BEDDING FOUNDATION

CROSS REFERENCE TO RELATED APPLICATION

This application claims the benefit of U.S. Provisional Patent Application No. 60/254,122 filed Dec. 8, 2000 entitled "Stackable Bedding Foundation."

FIELD OF THE INVENTION

This invention relates generally to bedding, and more particularly to an improved testable and stackable bedding foundation.

BACKGROUND OF THE INVENTION

There is a continuing search for a higher quality, more durable mattress and box spring combination that has a longer service life and can be manufactured more efficiently and for less cost. One example of an improved box spring design is one in which the wire core assembly within the box spring is testable and stackable with other wire core assemblies. Such stackability substantially reduces the cost of storing and/or shipping numerous wire core assemblies.

In known box spring-mattress combinations, box springs are generally used to provide predominately static support for a mattress and user, and the mattress is used to provide most, if not all, of the resilient support for the user. For example, the mattress deforms and conforms to the load presented by the shape and weight of the user, and the mattress resiliently returns to its original shape when the load of the user is removed. The box spring usually experiences little, if any, deformation under the load of the user.

A common practice in the design of a box spring or mattress support is to attempt to match the resiliency characteristics of a box spring with the resiliency of a mattress to provide a more comfortable sleeping surface. Heretofore, that has been difficult to accomplish using a box spring which has a testable, stackable wire core assembly because of the limited flexibility of known nestably flexible box springs such as the one described in U.S. Pat. No. 5,361,434.

Consequently, there is a need for an improved box spring and particularly an improved testable, stackable box spring in which the resiliency and load bearing capability of the box spring can be better matched to the resiliency and load bearing capability of a mattress, thereby creating an improved mattress-box spring combination.

SUMMARY OF THE INVENTION

The present invention provides an improved nestably stackable box spring that provides better support for a mattress. The box spring of the present invention has a resilient load bearing capability that can be advantageously matched to the resiliently load bearing capability of a mattress. Further, the resilient load bearing capability of the box spring of the present invention is especially useful in improving the edge load bearing capability of a mattress-box spring combination. Therefore, the box spring of the present invention provides a higher quality, more durable, testable, stackable box spring that is potentially more efficient to manufacture.

According to the principles of the present invention and in accordance with the described embodiment, the invention provides a nestably stackable assembly for use in a bedding foundation. The assembly has a rectangular border wire with parallel sides and ends. Transversely spaced, parallel and longitudinally extending support wires are connected at their ends to the border wire ends. The support wires are formed so as to be generally corrugated along their lengths with peaks and valleys. The peaks are flattened at their tops, and the flattened tops are generally coplanar with a plane defined by the border wire. The valleys are vertically displaced beneath and intermediate of said flattened tops. Longitudinally spaced and transversely extending, upper connector wires are connected to the sides of border wire, and the upper connector wires are connected along their lengths to the flattened tops of the peaks of the support wires. The valleys have flat bottoms, and adjacent pairs of the flat bottoms of the valley are interconnected by flexible connectors. The flexible connectors of the nestably stackable assembly are attached to a rigid, generally wooden, base of the bedding foundation.

In one aspect of the invention, the flexible connectors are resilient; and the bedding foundation resiliently absorbs loads in partnership with a mattress. Such a box spring construction is especially useful in providing additional support along the edges of the mattress.

These and other objects and advantages of the present invention will become more readily apparent during the following detailed description taken in conjunction with the drawings herein.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
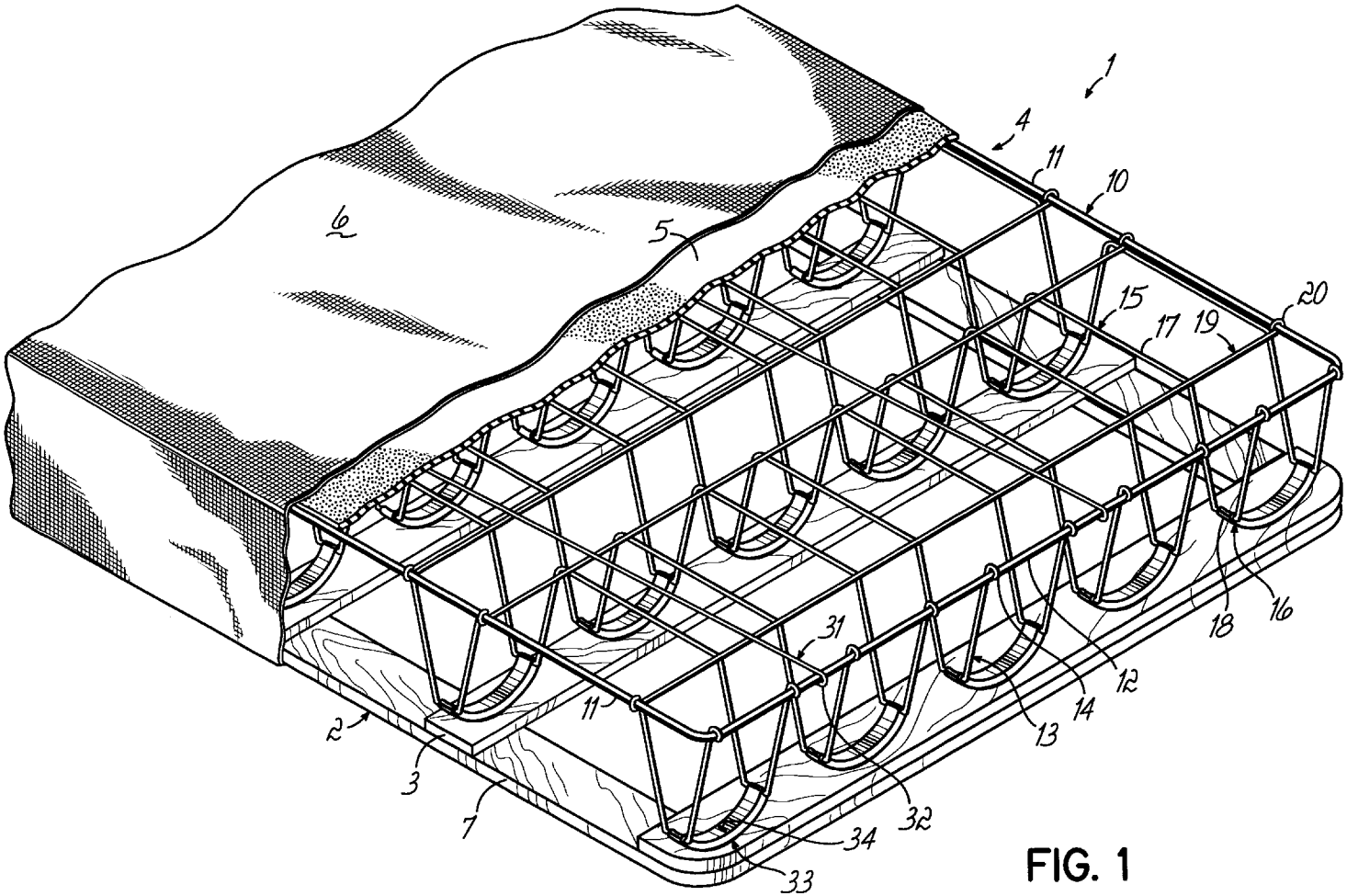
FIG. 1 is a perspective view, partially broken away, of a bedding foundation assembly in accordance with the principles of the present invention.

Referring to FIG. 1, a bedding foundation or box spring 1 is illustrated. The foundation 1 has a rectangular wooden base 2 comprised of a frame 7 on which are attached transverse wooden slats 3. Atop these transverse slats 3 is the nestably stackable wire core assembly 4. A foam pad 5 overlies the wire core assembly 4, and a fabric covering 6 overlies the foam pad 5 and surrounds the wire core assembly 4 and the base 2.

The wire core assembly 4 comprises a rectangular steel border wire 10 having two parallel sides 11, 11 extending over the length of the assembly 4. Two parallel ends extend over the width of the assembly 4, and one end is shown at 12. Steel support wires 13 are spaced across the width of the assembly 4 and extend over the length of the assembly 4 parallel to the border wire sides 11, 11. The steel support wires 13 have ends 14 that are crimped or wrapped around each of the ends 12 of the border wire 10. The support wires 13 are formed so as to be generally corrugatedly-shaped along their lengths, having peaks 15 and valleys 16. These peaks 15 and valleys 16 have respective flattened tops and bottoms 17, 18, respectively. The flattened tops 17 of the peaks 15 are generally coplanar with the plane defined by the border wire 10, and the flattened bottoms 18 of the valleys 16 are vertically spaced beneath and intermediate the flattened tops 17 of the peaks 15.

Steel upper connector wires 19 are spaced along the length of the wire core assembly 4 and extend over the width of the assembly 4 parallel to each of the border wire ends 12. The steel upper connector wires 19 have ends 20 which are crimped or wrapped around sides 11, 11 of the border wire 10. The upper connector wires 19 are welded intermediate of their ends along their lengths to the flattened tops 17 of the peaks 15 of the support wires 13.

If desired, continuous longitudinal wires 31 may be added either before or after the stackable assembly 4 has reached its final assembly destination. The longitudinal wires 31 have their ends 32 crimped around respective ones of the border wire ends 12. The wires 31 may be welded along their lengths to the upper connector wires 19 as desired. The wires 31 provide additional stiffness to the stackable assembly 4 at the ends of the assembly 4 so as to prevent the ends 12 of the border wire 10 from deflecting and permanently distorting when a person sits on the end of a bed which is supported by the foundation 1.

In this embodiment, the upper connector wires 19 are welded intermediate of their ends along their lengths to the underneath sides of the flattened tops 17 of the peaks 15 of the support wires 13. This allows the longitudinal wires 31 to rest atop and be generally coplanar with the flattened tops 17 of the peaks 15.

Referring to FIG. 1, adjacent pairs of the flattened bottoms 18 of the valleys 16 extending laterally between the sides 11 are connected by flexible, arcuate connectors 33. The connectors 33 are attached to the transverse cross slats 3 by a staple or other fastener 34 that is applied at about the center of each connector 33 where it contacts a respective transverse slat 3.

Figure 2:
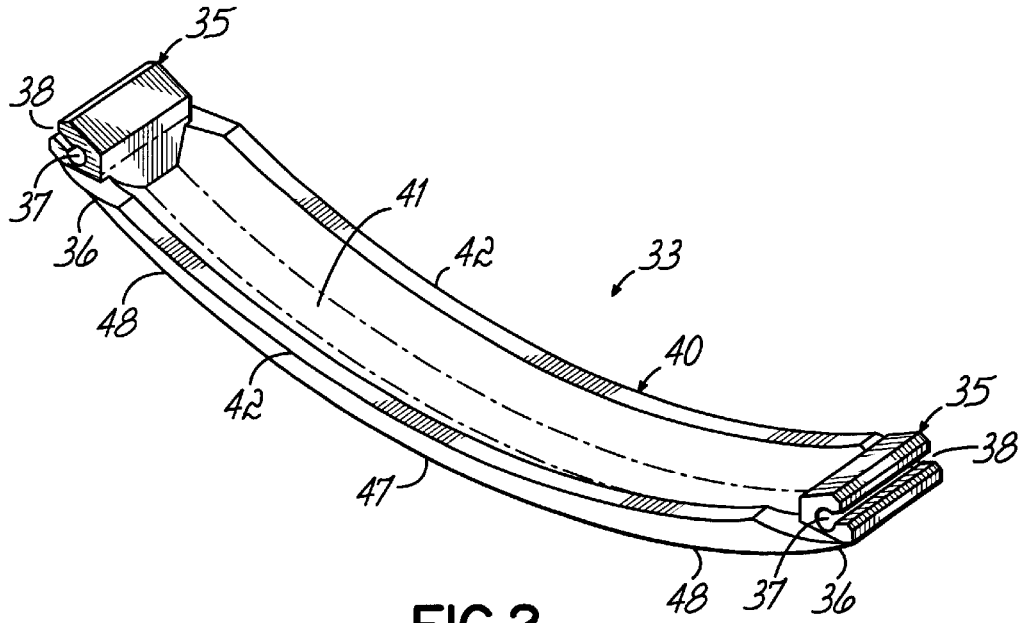
FIG. 2 is a full perspective view of a flexible connector used in a wire core assembly of the bedding foundation of FIG. 1.
Figure 3:
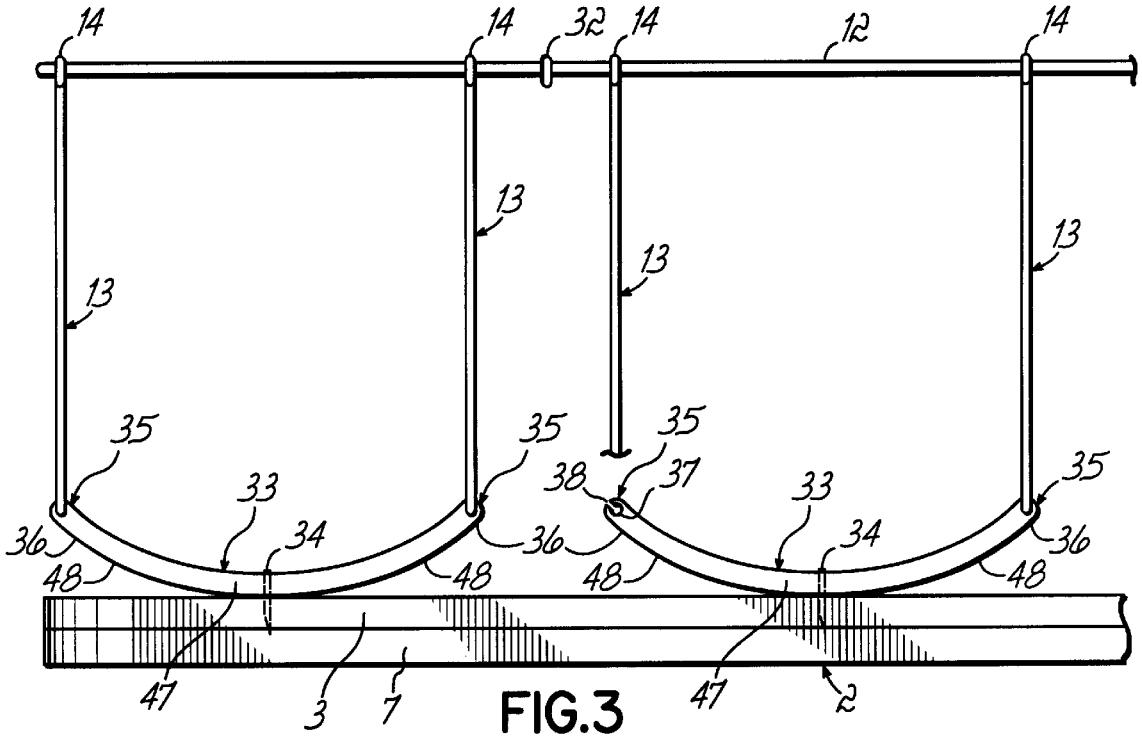
FIG. 3 is a partial end view of the wire core assembly of the bedding foundation of FIG. 1.

Referring to FIGS. 2 and 3, each connector 33 has a body 40 with a generally C-shaped side profile and a generally U-shaped cross-sectional profile transverse to its length. The body 40 has a bottom wall 41 and opposed side walls 42. The body 40 has a center section 47 that is attached to the base 2 with a staple or other fastener 34. Opposed arm sections 48 extend upward and outward from the center section 47, and the opposed arm sections 48 terminate with clip sections 35. Each clip section 35 has a substantially circular hole 37 extending longitudinally through the clip section. The clip hole 37 is sized to receive a wire forming a flattened bottom 18 of a valley 16 as shown in FIG. 1. The hole 37 in each clip section 35 opens up on one side to form a slot or mouth 38. The slot 38 has side walls that are separated by a distance that is slightly smaller than the diameter of the hole 37; and thus, the hole 37 and mouth 38 are generally keyhole shaped. As shown in FIG. 3, each clip section 35 is attached to a flattened bottom 18 by pressing the slot 38 over the flattened bottom 18 until the slot 38 spreads sufficiently to permit the flattened bottom 18 to snap into the hole 37. The smaller size of the slot 38 effectively locks the end 36 of the connector 33 onto the flattened bottom 18 of the valley 16.

The connector 33 is resilient and functions as a spring that adds about 1.00 inch to the height or thickness of the finished foundation 1. The connector 33 normally has a working deflection of about 0.75 inch. The resilient spring connector 33 is made of any material that provides a desired spring constant of, for example, about 1.1 Kg/mm and a full deflection force of, for example, about 21–42 Kg at 19 mm full deflection. Examples of such materials are a natural polypropylene or a "BAYPOLENE" 5072.

Figure 5:
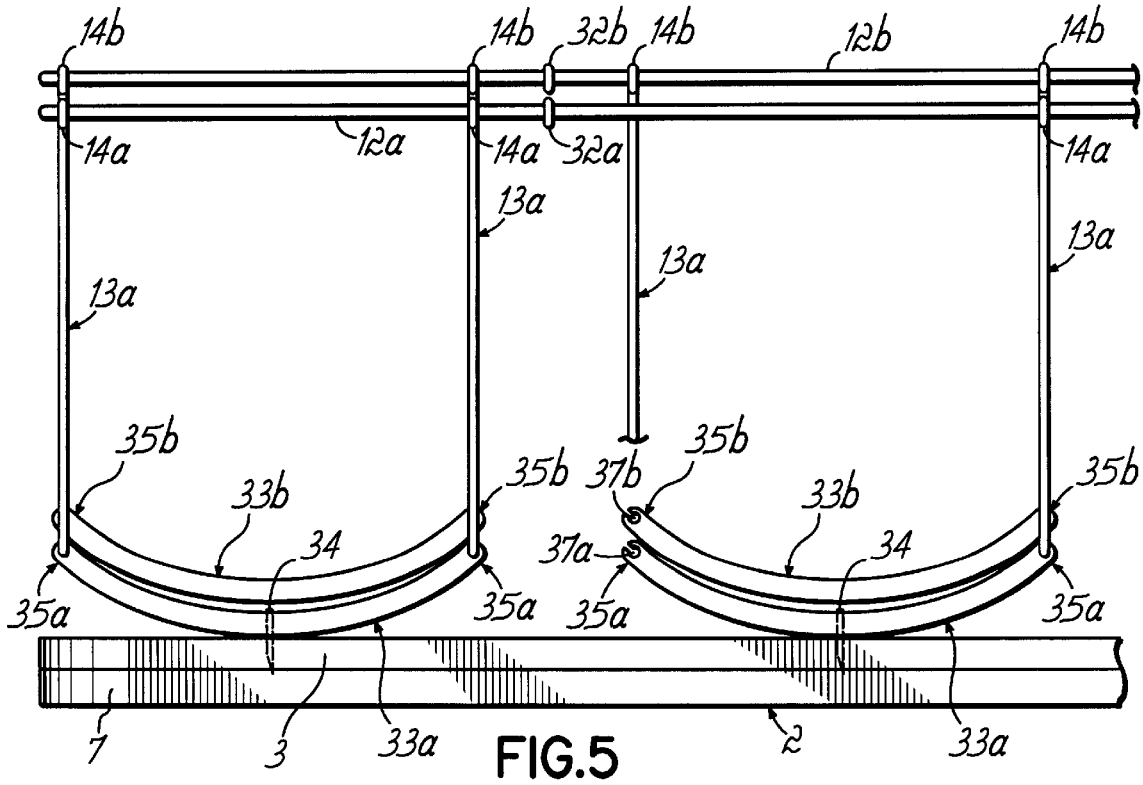
FIG. 5 is a partial end view of two wire core assemblies as shown in FIG. 1 that are fully stacked and nested for shipment.
Figure 4:
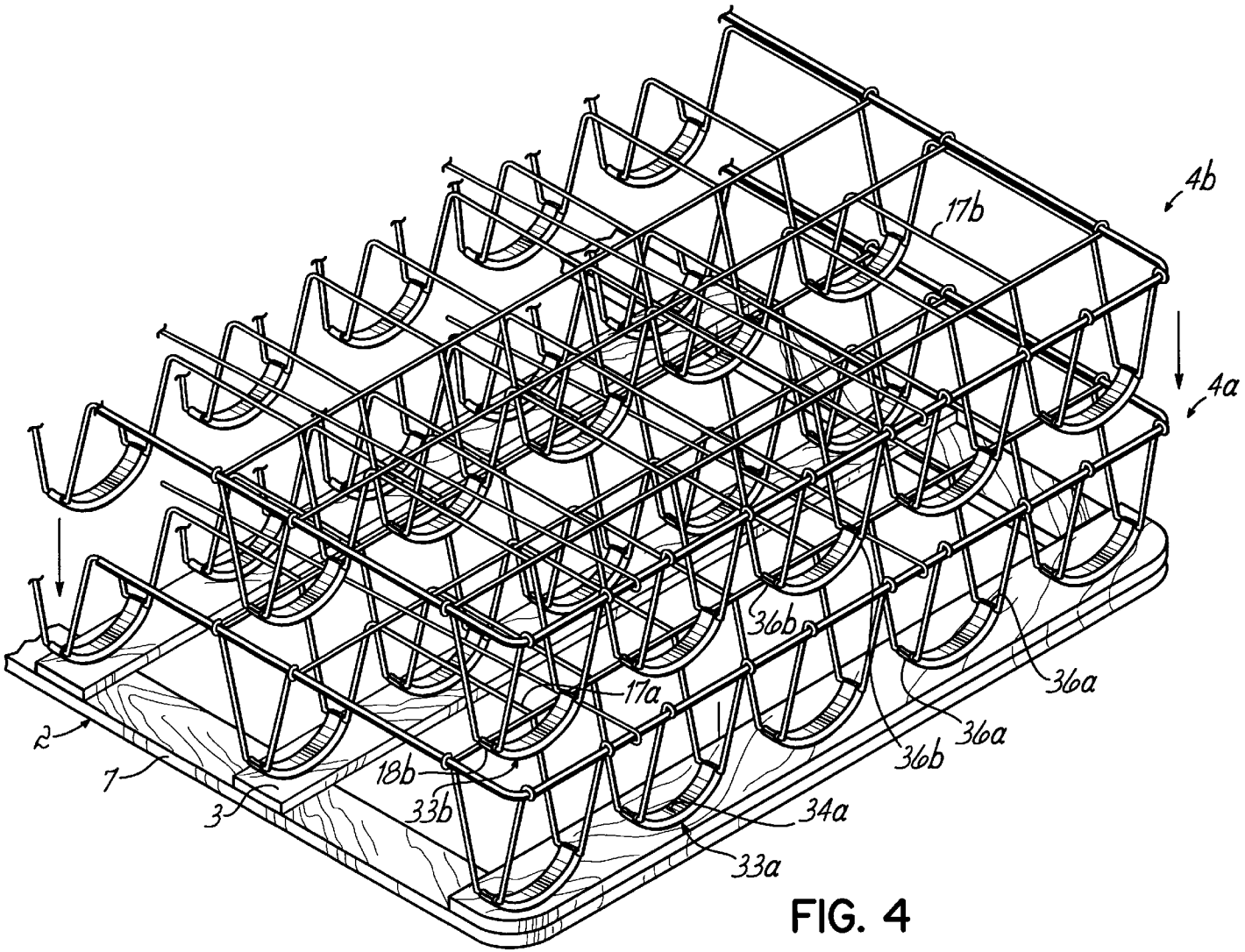
FIG. 4 is a partial perspective view of two wire core assemblies as shown in FIG. 1 that are in the process of being stacked and nested for shipment.

In use, the wire core assembly 4 of the bedding foundation 1 is often manufactured by a supplier, who then ships it to an assembler. The assembler mounts the wire core assembly 4 on a wooden base 2 and slats 3 and adds padding 5 and upholstery 6 to make a completed foundation product 1. With reference to FIG. 4, a first stackable wire core assembly 4*a* may be attached, for example, with staples 34*a*, to a surface such as transverse slats 3*a*. In FIG. 4 as well as other FIGS., like numbered elements with those in FIGS. 1 and 2 are substantially identical to the elements illustrated in FIGS. 1 and 2. The connectors 33*a* are oriented downwardly and the flattened peaks 17*a* of the support wires 13*a* are oriented upwardly. Next, a second wire core assembly 4*b* is placed atop the first assembly 4*a*, with its connectors 33*b* and flattened support wire peaks 17*b* likewise oriented downwardly and upwardly, respectively. The connectors 33*b* and flattened valleys 18*b* of the second assembly 4*b* enter into the voids between the flattened peaks 17*a* of the first assembly 4*a*. The second assembly 4*b* nestles downwardly within the first assembly 4*a* until the ends 36*b* of the connectors 33*b* contact the ends 36*a* of the connectors 33*a* as shown in FIG. 4. Referring to FIG. 5, for optimum stacking, the distance separating the centerlines of the holes 37*a*, 37*b* in the respective clip sections 35*a*, 35*b* is about 10 mm. When the second wire core assembly 4*b* is fully nested or stacked within the first wire core assembly 4*a*, the overall height of the nested assemblies 4*a*, 4*b* is substantially less than the sum of the heights of the individual assemblies 4*a*, 4*b*. Any number of assemblies 4 may be nested and stacked together for storage or shipment.

Thus, the flexible, resilient connectors 33 are interposed between a lowermost portion of the wire core assembly 4 and the base or frame 2, 3 of the box spring or foundation 1. The connectors 33 give the box spring a resilient load bearing capability that can be advantageously matched to the resilient load bearing capability of a mattress (not shown). With the resilient connectors 33, the box spring 1 resiliently absorbs the load of the user in partnership with the mattress. A box spring 1 having the resilient connectors 33 is especially useful in providing additional edge support when the mattress-box spring combination is subjected to loading, for example, when the user sits on the edge of the mattress. Therefore, the box spring construction described herein provides a higher quality, more durable mattress-box spring combination that is potentially more efficient to manufacture.

While the invention has been illustrated by the description of one embodiment, and while the embodiment has been described in considerable detail, there is no intention to restrict nor in any way limit the scope of the appended claims to such detail. Additional advantages and modifications will readily appear to those who are skilled in the art. For example, one embodiment of a connector 33 for resiliently supporting the wire core assembly 4 is shown in FIG. 2. As will be appreciated, such a connector can have many different configurations and shapes. Examples of alternative configurations and shapes of the connector 33 are shown in FIGS. 6–9.

Figure 6A:
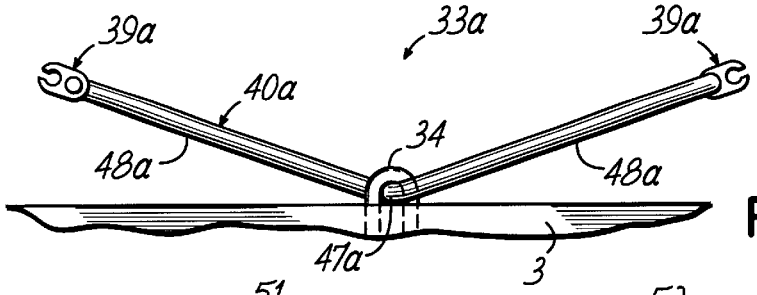
FIG. 6A is a side view of one alternative embodiment of the flexible connector used in the wire core assembly of the bedding foundation of FIG. 1.
Figure 6B:
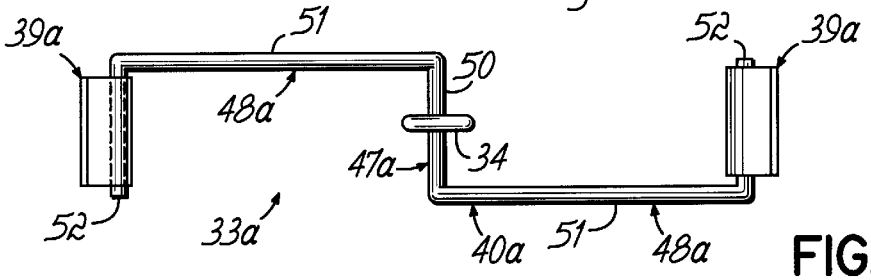
FIG. 6B is a top view of the one alternative embodiment of the flexible connector illustrated in FIG. 6A.

One alternative embodiment is illustrated in FIGS. 6A and 6B in which a connector 33*a* has a body 40*a* with a generally C-shaped side profile and a center section 47*a* that is attached to the base 2 with a staple or other fastener 34. Opposed arm sections 48*a* extend upward and outward from the center section 47*a,* and the opposed arm sections 48*a* terminate with clip sections 39*a*. Referring to FIG. 6B, the center section 47*a* is comprised of a center torsion bar 50. Each of the opposed arm sections 48*a* is comprised of a connecting arm 51 that is connected at a substantially right angle to one end of an end section 52. An opposite end of the connecting arm 51 is connected at a substantially right angle to one end of the torsion bar 50. The end sections 52 are substantially parallel to the center torsion bar 50, and the body 40*a* has a generally S-shape. The clip sections 39*a* are mounted on end sections 52 of the body 40*a*. Further, depending on the application, the clip sections 39*a* may be adhered, bonded, mechanically fastened to or otherwise appropriately secured to the end sections 52 as required. The body 40*a* may be made from conventional spring wire or other material that provides the desired resilient or spring properties to the body 40*a*. The clip section 39*a* can be molded from plastic or other material or manufactured by any other appropriate process. Other than the portion for mounting the clip section 39*a* to the end section 52, the clip section 39*a* can be substantially identical in size and shape to the clip section 35 described with respect to FIG. 2.

Figure 7A:
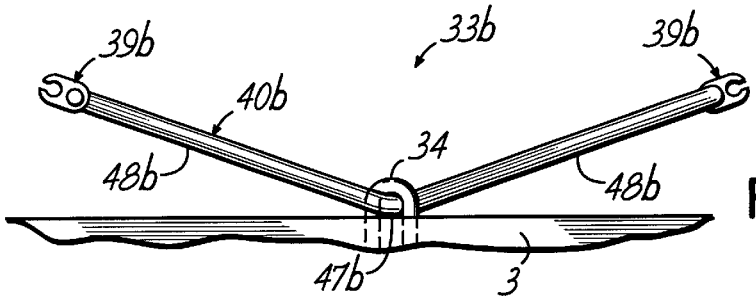
FIG. 7A is a side view of another alternative embodiment of the flexible connector used in the wire core assembly of the bedding foundation of FIG. 1.
Figure 7B:
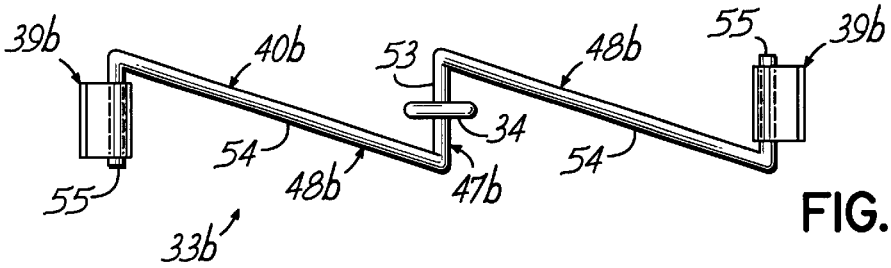
FIG. 7B is a top view of the other alternative embodiment of the flexible connector illustrated in FIG. 7A.

Another alternative embodiment is illustrated in FIGS. 7A and 7B in which a connector 33*b* has a body 40*b* with a generally C-shaped side profile and a center section 47*b* that is attached to the base 2 with a staple or other fastener 34. Opposed arm sections 48*b* extend upward and outward from the center section 47*b,* and the opposed arm sections 48*b* terminate with clip sections 39*b*. Referring to FIG. 7B, the center section 47*b* is comprised of a center torsion bar 53. Each of the opposed arm sections 48*b* is comprised of a connecting arm 54 that is connected at an angle to one end of an end section 55. An opposite end of the connecting arm 54 is connected at an angle to one end of the torsion bar 53. The end sections 55 are substantially parallel to the center torsion bar 53, and the center torsion bar 53 forms a Z-shape with each of the connecting arms 54 and associated end sections 55. The clip sections 39*b* are mounted on end sections 55 of the body 40*b*. Further, depending on the application, the clip sections 39*b* may be adhered, bonded, mechanically fastened to or otherwise appropriately secured to the end sections 55 as required. The body 40*b* may be made from conventional spring wire or other material that provides the desired resilient or spring properties to the body 40*b*. The clip section 39*b* can be molded from plastic or other material or manufactured by any other appropriate process. Other than the portion for mounting the clip section 39*b* to the end section 55, the clip section 39*b* is substantially identical in size and shape to the clip section 35 described with respect to FIG. 2.

Figure 8A:
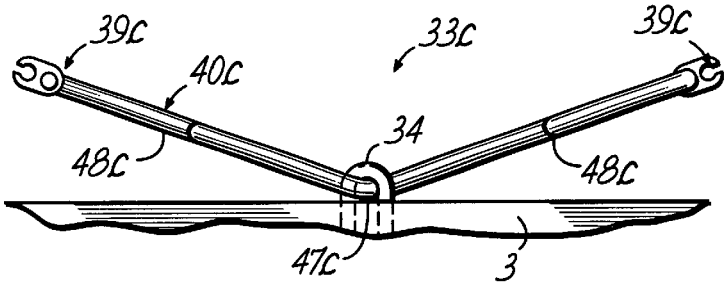
FIG. 8A is a side view of a further alternative embodiment of the flexible connector used in the wire core assembly of the bedding foundation of FIG. 1.
Figure 8B:
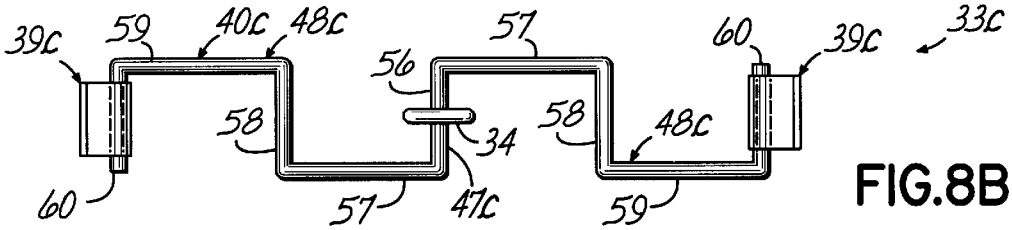
FIG. 8B is a top view of the further alternative embodiment of the flexible connector illustrated in FIG. 8A.

A further alternative embodiment is illustrated in FIGS. 8A and 8B in which a connector 33*c* has a body 40*c* with a generally C-shaped side profile and a center section 47*c* that is attached to the base 2 with a staple or other fastener 34. Opposed arm sections 48*c* extend upward and outward from the center section 47*c,* and the opposed arm sections 48*c* terminate with clip sections 39*c*. Referring to FIG. 8B, the center section 47*c* is comprised of a center torsion bar 56. Each of the opposed arm sections 48*a* is comprised of a first and second connecting arms 57, 59, respectively, outer torsion bars 58 and end sections 60. The first connecting arms 57 are connected at substantially right angles between the ends of the center torsion bar 56 and the ends of outer torsion bars 58. Second connecting arms 59 are connected at substantially right angles between the ends of the outer torsion bars 58 and end sections 60. The center torsion bar 56, outer torsion bars 58 and end sections 60 are substantially parallel; and the first connecting arms 57 are substantially parallel to the second connecting arms 59. The clip sections 39*c* are mounted on end sections 60 of the body 40*c*. Further, depending on the application, the clip sections 39*c* may be adhered, bonded, mechanically fastened to or otherwise appropriately secured to the end sections 60 as required. The body 40*c* may be made from conventional spring wire or other material that provides the desired resilient or spring properties to the body 40*c*. The clip section 39*c* can be molded from plastic or other material or manufactured by any other appropriate process. Other than the portion for mounting the clip section 39*c* to the end section 60, the clip section 39*c* is substantially identical in size and shape to the clip section 35 described with respect to FIG. 2.

Figure 9A:
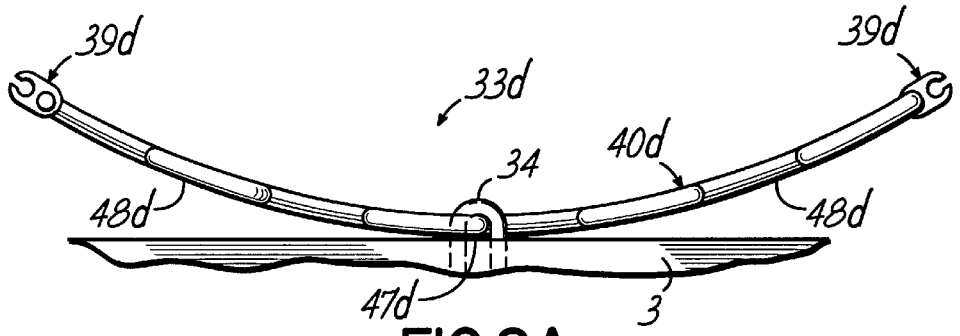
FIG. 9A is a side view of a still further alternative embodiment of the flexible connector used in the wire core assembly of the bedding foundation of FIG. 1.
Figure 9B:
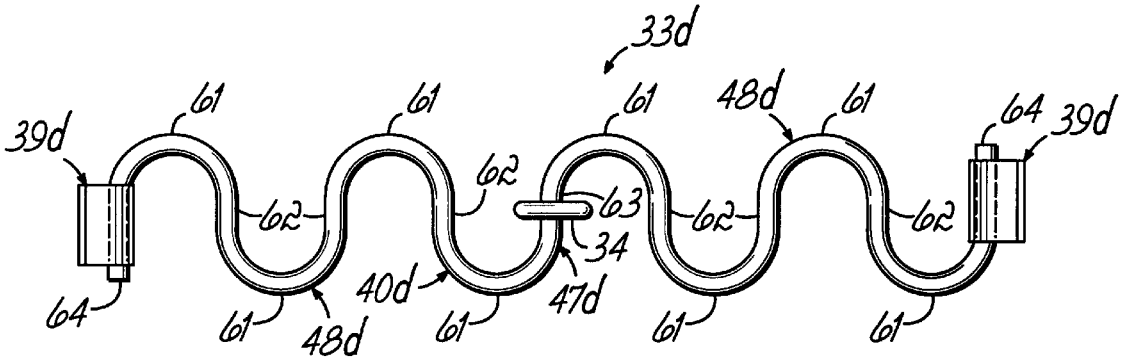
FIG. 9B is a top view of the still further alternative embodiment of the flexible connector illustrated in FIG. 9A.

A still further alternative embodiment is illustrated in FIGS. 9A and 9B in which a connector 33*d* has a body 40*d* with a generally C-shaped side profile and a center section 47*d* that is attached to the base 2 with a staple or other fastener 34. Opposed arm sections 48*d* extend upward and outward from the center section 47*d,* and the opposed arm sections 48*d* terminate with clip sections 39*d*. Referring to FIG. 9B, the center section 47*d* is comprised of a center torsion bar 63. Each of the opposed arm sections 48*d* is sinuous and comprised of with a plurality of semicircular connecting arm sections 61 interconnecting a plurality of torsion bars 62. Each arm section 48*d* terminates with end sections 64. The clip sections 39*d* are mounted on end sections 64. Further, depending on the application, the clip sections 39*d* may be adhered, bonded, mechanically fastened to or otherwise appropriately secured to the end sections 64 as required. The body 40*d* may be made from conventional spring wire or other material that provides the desired resilient or spring properties to the body 40*d*. The clip section 39*d* can be molded from plastic or other material or manufactured by any other appropriate process. Other than the portion for mounting the clip section 39*d* to the end section 64, the clip section 39*d* is substantially identical in size and shape to the clip section 35 described with respect to FIG. 2.

Figure 10A:
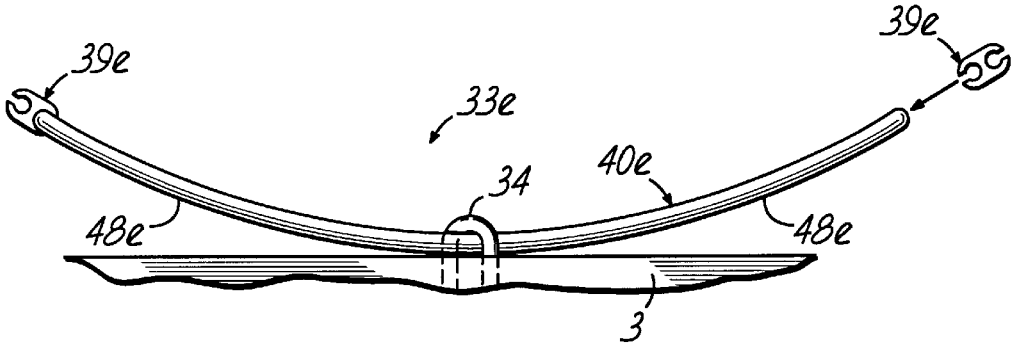
FIG. 10A is a side view of still another alternative embodiment of the flexible connector used in the wire core assembly of the bedding foundation of FIG. 1.
Figure 10B:
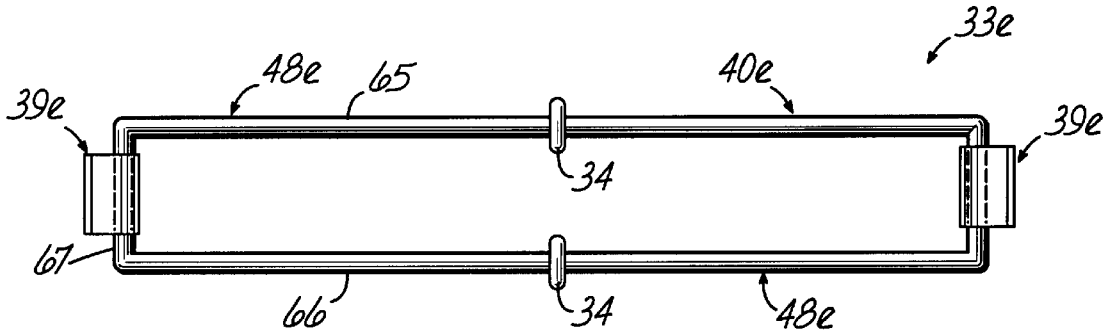
FIG. 10B is a top view of the still other alternative embodiment of the flexible connector illustrated in FIG. 10A.

Still another alternative embodiment is illustrated in FIGS. 10A and 10B in which a connector 33*e* has a body 40*e* with a generally C-shaped side profile and a center section 47*e* that is attached to the base 2 with a staple or other fastener 34. Opposed arm sections 48*e* extend upward and outward from about their center, and the opposed arm sections 48*e* terminate with clip sections 39*e*. Referring to FIG. 10B, each of the opposed arm sections 48*e* is comprised of a pair of parallel arms 65, 66 that are connected at one end by an end 67. Thus, the arms 65, 66 and end 67 have a generally U-shaped configuration. Further, the ends of each of the arm sections 48*a*, 48*a* are connected such that the arm sections 48*a*, 48*a* are configured for form a quadrilateral shape, for example, a rectangle. The clip sections 39*e* are mounted on ends 67. Further, depending on the application, the clip sections 39*e* may be adhered, bonded, mechanically fastened to or otherwise appropriately secured to the ends 67 as required. The body 40*e* may be made from conventional spring wire or other material that provides the desired resilient or spring properties to the body 40*e*. The clip sections 39*e* can be molded from plastic or other material or manufactured by any other appropriate process. Other than the portion for mounting the clip section 39*e* to the ends 67, the clip section 39*e* is substantially identical in size and shape to the clip section 35 described with respect to FIG. 2.

The above-described embodiments are exemplary, and the connector 33 can have any configuration and shape and be made from any material that provides the connector 33 with the desired resilient load bearing support of the wire core assembly 4 of the foundation 1. Further, while several variations of clips designs have been illustrated and described, as will be appreciated, other clip designs may be used that perform the desired function of connecting the connectors 33 to the bottoms 18 of the support wires 13.

Therefore, the invention in its broadest aspects is not limited to the specific details shown and described. Consequently, departures may be made from the details described herein without departing from the spirit and scope of the claims which follow.

What is claimed is:

1. A nestably stackable assembly for use in a bedding foundation comprising:

a rectangular border wire having two parallel sides and two parallel ends, transversely spaced, parallel and longitudinally extending support wires parallel to said border wire sides and having ends connected to said border wire ends, said support wires being formed so as to be generally corrugated along their lengths, said corrugatedly formed support wires having peaks and valleys, said peaks being flattened at their tops, said flattened peaks being generally coplanar with a plane defined by said border wire, said valleys being vertically displaced beneath and intermediate of said flattened peaks, longitudinally spaced, parallel and transversely extending upper connector wires parallel to said border wire ends and having ends connected to said border wire sides, said upper connector wires being connected intermediate of their ends along their lengths to said flattened peaks of said support wires, and the improvement wherein adjacent valleys of a common support wire are interconnected by flexible curvilinear connectors, such that said valleys are adapted to be nestably stackable with valleys of support wires of an assembly having an identical construction.

2. The nestably stackable assembly of claim 1 wherein each of said flexible connectors comprises:

one end connected to one of said valleys of a support wire, another end connected to a valley of an adjacent support wire, and each of said connectors having an intermediate section located beneath said ends of said connectors, said intermediate section being adapted to be connected to a rigid base of a bedding foundation.

3. The nestably stackable assembly of claim 2 wherein each of said flexible connectors comprises opposite ends terminating with clip sections for attaching said opposite ends of said flexible connector to said valleys of adjacent support wires.

4. The nestably stackable assembly of claim 3 wherein each of said flexible connectors comprises:

a center section;

arm sections extending upward and outward from opposite sides of said center section, said center section and arms providing said flexible connector with a generally C-shaped side profile.

5. The nestably stackable assembly of claim 4 wherein each of said flexible connectors is made of a resilient material.

6. The nestably stackable assembly of claim 5 wherein each of said flexible connectors comprises a generally U-shaped cross-sectional profile transverse to its length and is molded as a unitary part with said clip sections.

7. The nestably stackable assembly of claim 5 wherein each of said flexible connectors is made from a resilient, sinuous wire.

8. The nestably stackable assembly of claim 7 wherein each of said flexible connectors further comprises:

a plurality of torsion bars;

two end sections; and a plurality of connecting arm sections, said plurality of torsion bars and said end sections being interconnected by said connecting arm sections.

9. The nestably stackable assembly of claim 8 wherein said connecting arm sections are connected to said torsion bars and said end sections at substantially right angles.

10. The nestably stackable assembly of claim 8 wherein each of said connecting arm sections is substantially semicircular.

11. The nestably stackable assembly of claim 3 wherein each of said flexible connectors comprises:

a pair of generally C-shaped arm sections; and a pair of end sections, the end sections having ends connected to ends of respective pairs of arm sections to form a generally rectangular shaped flexible connector.

12. The nestably stackable assembly of claim 11 wherein each of said flexible connectors is made of a resilient material.

13. The nestably stackable assembly of claim 12 wherein each of said flexible connectors is made from a resilient wire.

14. A nestably stackable assembly for use in a bedding foundation comprising:

a rectangular border wire having two parallel sides and two parallel ends, transversely spaced, parallel and longitudinaly extending support wires parallel to said border wire sides and having ends connected to said border wire ends, said support wires being formed so as to be generally corrugated along their lengths, said corrugatedly formed support wires having peaks and valleys, said peaks being flattened at their tops, said flattened peaks being generally coplanar with a plane defined by said border wire, said valleys being vertically displaced beneath and intermediate of said flattened peaks, longitudinally spaced, parallel and transversely extending upper connector wires parallel to said border wire ends and having ends connected to said border wire sides, said upper connector wires being connected intermediate of their ends along their lengths to said flattened peaks of said support wires, and a plurality of nonlinear connectors, each connector comprising a center torsion bar;

two arm sections, each arm section connected at one end to one end of said center torsion bar; and two end sections, each end section connected to an opposite end of one of said arm sections.

15. The nestably stackable assembly of claim 14 wherein said center torsion bar, arm sections and end sections are made from a continuous piece of wire.

16. The nestably stackable assembly of claim 15 wherein each of said arm sections is connected diagonally between one end of said center torsion bar and one end of one of said arm sections, and said torsion bar and said end sections are parallel.

17. The nestably stackable assembly of claim 14 wherein said arm sections are connected at substantially right angles to said center torsion bar and said end sections are connected at substantially right angles to said arm sections.

18. A bedding foundation comprising:

a base;

a nestably stackable assembly comprising:

a rectangular border wire having two parallel sides and two parallel ends, transversely spaced, parallel and longitudinally extending support wires parallel to said border wire sides and having ends connected to said border wire ends, said support wires being formed so as to be generally corrugated along their lengths, said corrugatedly formed support wires having peaks and valleys, said peaks being flattened at their tops, said flattened peaks being generally coplanar with a plane defined by said border wire, said valleys being vertically displaced beneath and intermediate of said flattened peaks, longitudinally spaced, parallel and transversely extending upper connector wires parallel to said border wire ends and having ends connected to said border wire sides, said upper connector wires being connected intermediate of their ends along their lengths to said flattened peaks of said support wires, and flexible connectors interconnecting said valleys of adjacent pairs of support wires and elevating said valleys above the base, a plurality of the flexible connectors being attached to the base; and a covering disposed around the a nestably stackable assembly.

19. The bedding foundation of claim 18 wherein the flexible connectors are made of a resilient material.

20. A nestably stackable assembly for use in a bedding foundation comprising:

a rectangular border wire having two parallel sides and two parallel ends;

transversely spaced, parallel and longitudinally extending support wires parallel to the border wire sides and having ends connected to the border wire ends, the support wires being formed so as to be generally corrugated along their lengths, the corrugatedly formed support wires having peaks and valleys, the peaks being flattened at their tops, the flattened peaks being generally coplanar with a plane defined by the border wire, the valleys being vertically displaced beneath and intermediate of the flattened peaks;

longitudinally spaced, parallel and transversely extending upper connector wires parallel to the border wire ends and having ends connected to the border wire sides, the upper connector wires being connected intermediate of their ends along their lengths to the flattened peaks of the support wires; and a plurality of connectors, each of the connectors comprising two opposed ends, each end being attached to a different one of two adjacent valleys, and a curvilinear intermediate section between the opposed ends extending downward away from and elevating the valleys, the intermediate section adapted to add height to the bedding foundation.

21. A nestably stackable assembly for use in a bedding foundation comprising:

a rectangular border wire having two parallel sides and two parallel ends;

transversely spaced, parallel and longitudinally extending support wires parallel to the border wire sides and having ends connected to the border wire ends, the support wires being formed so as to be generally corrugated along their lengths, the corrugatedly formed support wires having peaks and valleys, the peaks being flattened at their tops, the flattened peaks being generally coplanar with a plane defined by the border wire, the valleys being vertically displaced beneath and intermediate of the flattened peaks;

longitudinally spaced, parallel and transversely extending upper connector wires parallel to the border wire ends and having ends connected to the border wire sides, the upper connector wires being connected intermediate of their ends along their lengths to the flattened peaks of the support wires; and a plurality of connectors, each of the connectors comprising two opposed ends, each end being nonrigidly attached to a different one of two transversely extending adjacent valleys.

22. A nestably stackable assembly for use in a bedding foundation comprising:

a rectangular border wire having two parallel sides and two parallel ends;

transversely spaced, parallel and longitudinally extending support wires parallel to the border wire sides and having ends connected to the border wire ends, the support wires being formed so as to be generally corrugated along their lengths, the corrugatedly formed support wires having peaks and valleys; the peaks being flattened at their tops, the flattened peaks being generally coplanar with a plane defined by the border wire, the valleys being vertically displaced beneath and intermediate of the flattened peaks;

longitudinally spaced, parallel and transversely extending upper connector wires parallel to the border wire ends and having ends connected to the border wire sides, the upper connector wires being connected intermediate of their ends along their lengths to the flattened peaks of the support wires; and a plurality of connectors, each of the connectors comprising two opposed ends, each end being removably attached to a different one of two transversely extending adjacent valleys.

23. A nestably stackable assembly for use in a bedding foundation comprising:

a rectangular border wire having two parallel sides and two parallel ends;

transversely spaced, parallel and longitudinally extending support wires parallel to the border wire sides and having ends connected to the border wire ends, the support wires being formed so as to be generally corrugated along their lengths, the corrugatedly formed support wires having peaks and valleys; the peaks being flattened at their tops, the flattened peaks being generally coplanar with a plane defined by the border wire, the valleys being vertically displaced beneath and intermediate of the flattened peaks;

longitudinally spaced, parallel and transversely extending upper connector wires parallel to the border wire ends and having ends connected to the border wire sides, the upper connector wires being connected intermediate of their ends along their lengths to the flattened peaks of the support wires; and a plurality of resilient connectors, each of the connectors being connected to a pair of adjacent valleys, and the connectors not connecting adjacent pairs of adjacent valleys.

24. A nestably stackable assembly for use in a bedding foundation comprising:

a rectangular border wire having two parallel sides and two parallel ends;

transversely spaced, parallel and longitudinally extending support wires parallel to the border wire sides and having ends connected to the border wire ends, the support wires being formed so as to be generally corrugated along their lengths, the corrugatedly formed support wires having peaks and valleys, the peaks being flattened at their tops, the flattened peaks being generally coplanar with a plane defined by the border wire, the valleys being vertically displaced beneath and intermediate of the flattened peaks;

longitudinally spaced, parallel and transversely extending first upper connector wires parallel to the border wire ends and having ends connected to the border wire sides, the first upper connector wires being connected intermediate of their ends along their lengths to the flattened peaks of the support wires;

transversely spaced, parallel and longitudinally extending second upper connector wires parallel to the border wire sides and having ends connected to the border wire ends; and a plurality of curvilinear resilient connectors, each of the connectors being connected to a pair of adjacent valleys.

* * * * *